United States Patent [19]

Mravic et al.

[11] 4,116,686

[45] Sep. 26, 1978

[54] COPPER BASE ALLOYS POSSESSING IMPROVED PROCESSABILITY

[75] Inventors: Brian Mravic, North Haven; Stanley Shapiro, New Haven; Derek E. Tyler, Cheshire; Abid Khan, Hamden, all of Conn.

[73] Assignee: Olin Corporation, New Haven, Conn.

[21] Appl. No.: 827,495

[22] Filed: Aug. 25, 1977

Related U.S. Application Data

[63] Continuation-in-part of Ser. No. 686,173, May 13, 1976, abandoned.

[51] Int. Cl.[2] ..... C22C 9/02; C22D 1/08

[52] U.S. Cl. ..... 75/154; 148/11.5 C; 148/12.7 C

[58] Field of Search ..... 75/154, 76, 32.5; 148/160, 13.2, 12.7 C, 11.5 C

[56] References Cited

U.S. PATENT DOCUMENTS

| | | | |
|---|---|---|---|
| 2,059,557 | 11/1936 | Corson | 75/154 |
| 2,210,670 | 8/1940 | Kelly | 75/154 |
| 3,923,558 | 12/1975 | Shapiro | 75/154 |

*Primary Examiner*—L. Dewayne Rutledge
*Assistant Examiner*—Peter K. Skiff
*Attorney, Agent, or Firm*—Paul Weinstein

[57] ABSTRACT

A copper base alloy is disclosed which exhibits improved resistance to crack propagation during hot processing as well as good mechanical properties. The alloy comprises from about 4.0 to about 11.0% tin, from about 0.01 to about 0.3% phosphorus, from about 1.0 to about 5.0% of a material selected from the group consisting of iron and a mixture of iron and cobalt, up to about 0.4% chromium, balance essentially copper. The alloy of the present invention possesses a substantially non-dendritic grain structure in the cast condition which contributes to said resistance to crack propagation.

9 Claims, 2 Drawing Figures

COPPER BASE ALLOYS POSSESSING IMPROVED PROCESSABILITY

CROSS REFERENCE TO RELATED APPLICATION

This application is a continuation-in-part of copending application Ser. No. 686,173 abandoned, for "Copper Base Alloys Possessing Improved Processability" by Brian Mravic, Stanley Shapiro, Derek E. Tyler and Abid Khan, filed May 13, 1976.

BACKGROUND OF THE INVENTION

The phosphor bronzes are copper base alloys containing phosphorus and tin. In this alloysystem, alloys with phosphorus levels in excess of 0.05% and tin levels in excess of 4% are most frequently used. These alloys are known for their poor hot workability, and typically exhibit pronounced cracking during hot rolling at moderately elevated temperatures. This severity of this hot cracking increases with the addition of increased amounts of phosphorus and tin with the result that it is economically impractical to hot roll these alloys at normal commercial hot rolling temperatures.

The foregoing problem was approached in U.S. Pat. No. 3,923,558, to Shapiro et al., commonly assigned. In the patent, certain combinations of iron, and/or cobalt and chromium were provided in a copper-tin-phosphorus alloy for the purpose of maintaining a refined grain size which contributed to improved processability. Improvement was in part achieved by the tendency of iron, cobalt and chromium to form phosphides to prevent the segregation of phosphorus into concentrated areas comprising low melting phases. Though improved processability was achieved in accordance with the Shapiro et al. patent, this improvement was not as consistent as is desirable in a commercial application.

SUMMARY OF THE INVENTION

The present invention comprises a copper base alloy which exhibits uniform and consistent improvement in resistance to crack propagation during hot processing, as well as good mechanical properties. The alloy comprises from about 4.0 to about 11.0% tin, from about 0.01 to about 0.3% phosphorus, from about 1.0 to about 5.0% of material selected from the group consisting of iron and a mixture of iron and cobalt, wherein the minimum iron plus cobalt content is determined by the equation: [% iron + (0.56)(%cobalt)] $\geqq$ [1.9 − (2)(% chromium)], up to about 0.4% chromium, balance essentially copper. The alloys of the present invention are characterized by the substantial absence of phosphorus-rich and tin-rich low-melting phases. The alloys of the present invention possess a substantially non-dendritic grain structure in the cast condition which contributes to their improved processability.

The alloys of the present invention possess a marked reduction in the incidence of edge cracking during hot rolling. Also, within the aforenoted ranges, the improved processability of the alloys is found to be substantially independent of processing, a feature which renders the alloys commercially attractive.

As indicated hereinabove, the alloys of the present invention exhibit a fine, substantially non-dendritic grain structure in the cast condition which is believed to be primarily responsible for the consistent improvement in resistance to crack propagation during hot rolling. The presence of the chromium and the iron and/or cobalt assures the absence of low-melting phosphorus-rich phases, as $Cu_3P$, through the formation of high-melting chromium, iron and/or cobalt phosphides as in U.S. Pat. No. 3,923,558.

The uniqueness of the present invention is the presence of a fine non-dendritic grain structure which has two beneficial effects relative to a dendritic grain structure typical of the prior art. First, there is a uniform distribution of the low-melting tin-rich phases. This uniformity promotes rapid and complete removal of these tin-rich phases during heating prior to hot working. It is well known that for a given degree of segregation, the homogenization time required to achieve a given degree of homogenization increases approximately as the square of the distance or scale over which diffusion must take place. As shown in FIGS. 1 and 2 herein, discussed in more detail hereinbelow, the dendritic microstructure is typically much coarser than the non-dendritic microstructure. The average secondary dendrite arm spacing of the alloy in FIG. 1 is about 0.003 inches, and the cast grain size is more than 10 times as large. In contrast, the average cast grain size in the non-dendritic alloy shown in FIG. 2 is less than 0.0025 inches. Thus, the time required to achieve a given degree of homogenization in the dendritic structure is expected to be approximately 50% greater than in the non-dendritic structure because of the greater distance over which diffusion must take place. Stated somewhat differently, the shorter average diffusion distances in the non-dendritic structure are expected to lead to more complete removal of tin segregation for a given homogenization treatment.

In addition to the foregoing, the very fine grain size characteristic of the non-dendritic structure itself minimizes cracking during hot working. The mechanism responsible for this effect is not completely understood. The cracks may initiate from weak regions in the structure caused by the presence of remnants of the aforenoted tin-rich phases, from weak tin-rich regions remaining because of insufficient homogenization, or from defects on the cast surface. Regardless of the origin of the cracks, macroscopic crack nucleation and propagation is greatly reduced in the fine grained non-dendritic material compared to the dendritic structure which typically has a cast grain size an order of magnitude greater.

Accordingly , it is a principal object of the present invention to provide improved copper base alloys of the phosphor-bronze type.

It is a particular object of the present invention to provide alloys as aforesaid which are hot workable at normal commercial hot working temperatures.

It is a still further object of the present invention to provide alloys as aforesaid which may be successfully processed independent of specific processing conditions.

It is yet a further object of the present invention to provide improved copper base alloys as aforesaid possessing good hot rollability in combination with improved mechanical properties.

Further objects and advantages of the present invention will appear from the specification which proceeds with reference to the following accompanying drawings.

DETAILED DESCRIPTION

Figure 1:
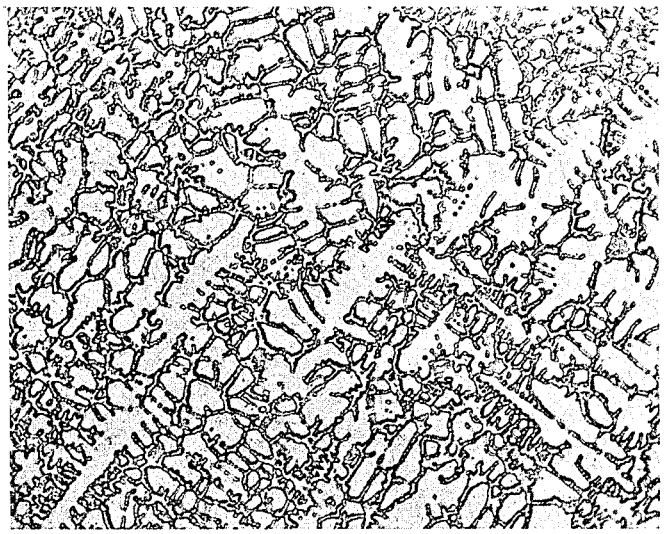
FIG. 1 is a photomicrograph of an alloy sample illustrating the presence of dendritic cast microstructure.

In accordance with the present invention, the foregoing ojects and advantages are readily attained.

The present invention comprises a copper base alloy comprising from about 4.0 to about 11.0% tin, from about 0.01 to about 0.3% phosphorus, from about 1.0 to about 5.0% of a material selected from the group consisting of iron and a mixture of iron and cobalt, up to about 0.4% chromium, balance essentially copper. Within the aforementioned ranges, the alloys of the present invention exhibit a substantially non-dendritic grain structure in the cast condition which is believed to be primarily responsible for the consistent improvement in resistance to crack propagation during hot rolling. The presence of a non-dendritic grain structure impedes cracking which results during hot working from the weakness in the structure caused by the presence of the aforenoted tin-rich and phosphorus-rich phases.

In the present invention, it has been found that the addition of the alloying elements noted above modifies the cast structure in such a way that the alloy is extremely resistant to crack propagation during hot working. Thus, any shallow cracks which may nucleate from either cast bar defects or internal structural defects within the cast ingots are effectively prevented from propagation. Specifically, the alloys of the present invention employ iron, and/or an iron-cobalt mixture in amounts greater than those specified in the aforementioned U.S. Pat. No. 3,923,558, together with a correspondingly reduced level of chromium to from 0 to 0.4%. Within the aforenoted ranges, the non-dendritic grain structure is obtained, and unexpected improvement in processability of the alloys is achieved.

The employment of high casting temperatures has been found to encourage the development of a surface layer on the alloy which has a high volume fraction of tin-rich and phosphorus-rich low melting phases. After soaking for hot rolling is conducted, these phases tend to remain in the surface layer with the result that cracks are easily initiated during hot rolling. This phenomenon known as inverse segregation is generally reduced when the alloy is cast at lower temperatures. Specifically, the employment of cobalt in place of iron in the alloy generally requires a substantial addition thereto which would require that the alloy be cast at temperatures elevated from normal levels. Accordingly, the employment of the iron addition together with or in place of cobalt is preferred.

As noted earlier, the alloys of the present invention contain tin, phosphorus, iron, or iron and cobalt and chromium in certain amounts. More particularly, the alloys may contain from 4.0 to 11.0% tin, 0.01 to 0.10% phosphorus, 1.9 to 3.0% iron, 0.05 to 0.3% chromium, balance copper. A particularly preferred composition contains 4.0 to 6.0% tin, 0.01 to 0.03% phosphorus, 1.9 to 2.5% iron, 0.1 to 0.3% chromium, balance copper.

The invention naturally contemplates the inclusion of particular additional alloying ingredients in order to obtain certain desired results. For example, one may include small but effective amounts of the elements of beryllium, magnesium, silicon, zinc, nickel, aluminum, arsenic, antimony or lead to improve mechanical properties, corrosion resistance, stress corrosion resistance, processing characteristics, machinability and other such properties. Naturally, other elements may be present in impurity levels which do not adversely affect the properties of the alloys.

In all instances where percentages are given herein, the percentages comprise percent by weight.

The alloy of the present invention may be cast in any convenient manner. The paticular method of casting is not critical, and any convenient commercial method such as direct chill casting may be used. The alloy may be hot worked at temperatures in excess of 700° C. using commercial equipment. The alloy should not be hot worked at a temperature in excess of 900° C., and the object being hot worked should not be allowed to cool below 400° C. during the hot working operation.

Prior to hot working, the alloy should be soaked at temperatures close to the hot working temperatures for a period of 15 minutes to 24 hours. This soaking treatment can consist merely of heating the object to the hot rolling temperature from room temperature during a period of 15 minutes to 24 hours and holding the object at the hot working temperature for a time long enough to allow the temperature to become uniform throughout the object.

The material may be cold rolled to the desired final gauge following hot rolling. The material may be rolled directly to final gauge, or several interannealing steps may be used. Intermediate annealing may be performed either as batch annealing or continuous strip annealing. The annealing treatments may consist of annealing temperatures in the range of 150° C.–900° C. for holding times of 10 seconds to 24 hours. The final condition of the strip may be the rolled condition or the annealed condition.

For intermediate batch annealing treatments it is advantageous to anneal at temperatures of 400° C. to 800° C. for times of 15 minutes to 5 hours. If the final condition is to be the soft annealed condition, the same annealing treatment is advantageous if a batch annealing process is used. If the final condition is to be a hard temper, it is sometimes advantageous after the final rolling step to batch anneal at temperatures of 150° C. to 400° C. for times of 15 minutes to 5 hours. This final annealing treatment reduces strength only slightly while greatly enhancing ductility and other properties.

The present invention will be made more readily understandable from a consideration of the following illustrative examples.

EXAMPLE I

Two alloys were prepared having the compositions shown in Table I, below.

TABLE I

| | Composition wt % | | | | | Casting Conditions | |
|---|---|---|---|---|---|---|---|
| Alloy | Sn | P | Fe | Cr | Cu | Temperature ° C | Casting Speed in./min. |
| A | 5.1 | 0.05 | 1.3 | 0.49 | Bal | 1155–1165 | 3.6 |
| B | 5.0 | 0.02 | 2.1 | 0.12 | Bal | 1150–1170 | 5.1 |

Alloy B was prepared in accordance with the present invention, while Alloy A was formulated for purposes of comparison to lie outside the ranges disclosed and claimed herein. Both alloys were semi-continuously cast as approximately 6 × 30 inches × 10 feet igots at a temperature ranging from 1150° to 1170° C. Upon solidification the ingots were sampled and examined to determine cast structure. As can be seen from a comparison of FIGS. 1 and 2, comprising, respectively, photomicrographs taken at 50X magnification of samples taken from Alloys A and B whose surfaces were treated with an etchant solution comprising 90% $NH_4OH$ and 10% $H_2O_2$, Alloy B, representing the present invention had a fine, equiaxed grain structure characterized as non-dendritic as shown in FIG. 2, whereas Alloy A exhibited the coarser dendritic grain structure generally characteristic of the alloys of the prior art as shown in FIG. 1.

Both ingots were then heated to a hot rolling temperatures of from 820° to 840° C. during a period of about 3 hours, and were then hot rolled to a thickness of about ½ inch. Alloy A exhibited severe edge cracking, whereas Alloy B representative of the present invention showed essentially no edge cracking whatsoever.

EXAMPLE II

Figure 2:
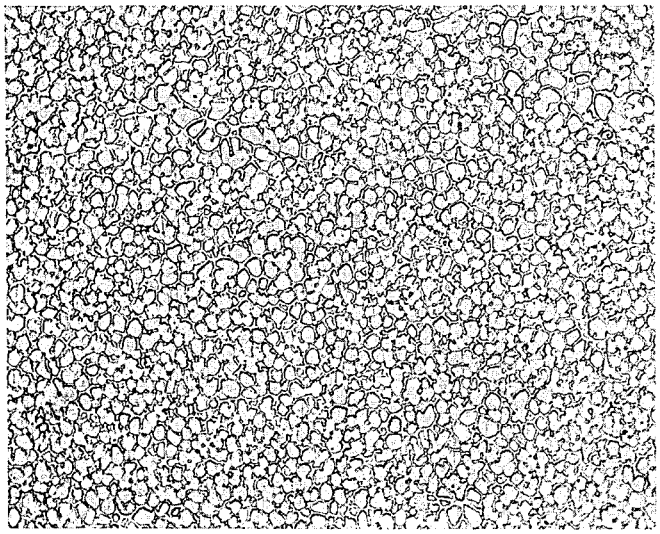
FIG. 2 is a photomicrograph illustrating the substantially non-dendritic cast microstructure of the alloys of the present invention.

A series of 10-lb chill castings were prepared from alloys containing approximately 5% tin, 0.03% phosphorus, up to 0.8% chromium, up to 2.4% iron, balance copper, for the purpose of defining a range of proportions of the alloying elements wherein the cast alloy exhibited the grain structure developed in Alloy B in Example I, as illustrated in FIG. 2. The castings were examined, and it was determined that, for the fixed tin and phosphorus values indicated above, the critical range or region of proportions of iron and chromium within which the desired non-dendritic cast structure may be obtained, is approximately bounded on one side by the line: (wt % Fe) = 1.9-2 × (wt % Cr). The region is approximately bounded on one of the adjacent sides by the line: wt % Cr = 0.4, while another adjacent side of the region is defined by the line: wt % Cr = 0. The boundary of a fourth side is not determined and thus the region consists of alloys containing from 0 to 0.4% chromium, with a minimum of 1.1 to 1.9% iron depending upon chromium content. Naturally, in the event that cobalt is substituted in part for iron, the primary equation would thus be altered as follows: [% iron + (0.56)(%cobalt)] ≧ [1.9 − (2)(% chromium)].

EXAMPLE III

A series of alloys was prepared for the purpose of comparing the alloys of the present invention with that of known phosphor bronzes including an alloy representing U.S. Pat. No. 3,923,558. The compositions of the alloys are set forth in Table II, below.

TABLE II

| Alloy | Cu % | Compositions Sn % | P % | Fe % | Cr % |
|---|---|---|---|---|---|
| C | Balance | 5.8 | 0.1 | 1.0 | 0.5 |
| D | Balance | 4.4 | 0.07 | — | — |
| E | Balance | 5.2 | 0.08 | — | — |
| F | Balance | 4.8 | 0.01 | 2.2 | 0.15 |

Referring to Table II, Alloy C was formulated in accordance with the disclosure of U.S. Pat. No. 3,923,558; Alloys D and E comprise conventional phosphor bronzes; and Alloy F represents the present invention.

Alloys C, D and E correspond to Alloys A, B and C set forth in Table 1A in U.S. Pat. No. 3,923,558, and were processed in the manner set forth in Example I of the patent. Alloy F was semi-continuously cast at 1175° C. in a water-cooled copper mold as a 10 foot long ingot measuring approximately 6 × 30 inches in cross section. The ingot was then heated from room temperature to a temperature of about 840° C. over a period of 3½ hours, corresponding to the homogenization disclosed in Example 1 of the patent. The ingot was then rolled to a thickness of 0.4 inch with a finishing temperature of above 600° C. The hot rolled alloy was then cold rolled approximately 54%, annealed at 600° C. for 1 hour and then cold rolled approximately 61%.

The alloy samples were then subjected to comparative tensile testing. Specifically, Alloy F was tested for yield strength, tensile strength and elongation and these results were compared with information drawn from Table IB of the patent, wherein the results of similar testing are set forth for Alloys C, D and E. The results of this comparison are set forth in Table III, below.

TABLE III

| Alloy | % Cold Reduction | Properties 0.2% Yield Strength (ksi) | Ultimate Tensile Strength (ksi) | Elongation (%) |
|---|---|---|---|---|
| C | 0 | 54 | 74 | 38 |
| D | 0 | 27 | 48 | 48 |
| E | 0 | 24 | 51 | 51 |
| F | 0 | — | 67 | 35 |
| C | 61 | 119 | 122 | 2.7 |
| D | 61 | 103 | 107 | 2.0 |
| E | 61 | 101 | 106 | 3.0 |
| F | 61 | 119 | 121 | 3.8 |

Referring to Table III, above, the properties of the respective alloy samples were compared in both the annealed condition and in the final cold rolled condition. It is apparent that the alloy of the present invention exhibits properties, particularly in the final cold rolled condition, which are equivalent or superior to the alloy of U.S. Pat. No. 3,923,558, and clearly superior to those of the phosphor bronze samples represented by Alloys D and E. It is therefore apparent that the alloys of the present invention possess favorable tensile properties in addition to a clear improvement in processability, as illustrated in Example I, resulting from the presence of the substantially non-dendritic cast structure obtained within the compositional ranges specified herein.

EXAMPLE IV

Additional alloy compositions were prepared and cast for the purpose of relating the cast microstructure to hot processability. The compositions of the alloys are listed in Table IV, below.

TABLE IV

| Alloy | Composition wt % Sn | P | Fe | Cr | Co |
|---|---|---|---|---|---|
| G | 5.05 | .05 | 1.3 | .49 | — |
| H | 5.1 | .03 | 1.36 | .47 | — |
| I | 4.9 | .05 | 1.4 | .40 | — |
| J | 4.8 | .04 | 1.55 | .40 | — |
| K | 4.7 | .02 | 1.42 | .35 | — |
| L | 5.3 | .026 | 1.76 | .24 | — |
| M | 5.4 | .013 | 1.6 | .20 | — |
| N | 5.05 | .028 | 1.25 | — | .80 |
| O | 5.0 | .03 | 1.25 | — | 1.2 |

Alloys G–L were DC castings whereas Alloys M, N and O were chill castings. After solidification the respective ingots were examined to determine their cast microstructure and were subsequently heated to 850° C. in 3 hours. The alloys were then hot rolled in two passes of 30% reduction each at a starting hot rolling temperature of 850° C., at which time their hot rollability was observed and noted. The observations which were made after casting and during hot rolling are presented in Table V, below.

TABLE V

| Alloy | Cast Microstructure | Hot Rollability At 850° C |
|---|---|---|
| G | Dendritic | Bad |
| H | Dendritic | Bad |
| I | Substantially Non-Dendritic | Good |
| J | Non-Dendritic | Good |
| K | Dendritic | Bad |
| L | Non-Dendritic | Good |
| M | Non-Dendritic | Good |
| N | Non-Dendritic | Good |
| O | Non-Dendritic | Good |

From Table V, above, it can be seen that those alloy samples lying within the ranges defined by the present invention possessed substantially non-dendritic cast microstructures. Correspondingly, the alloy samples possessing the non-dendritic cast structure exhibited good hot rollability in the rolling sequence which followed. This further supports the correlation between the provision of a non-dendritic cast structure in the alloys of the present invention and the resulting favorable hot rollability obtained therewith.

As illustrated above, the improvement in processability confers a distinct commercial advantage in the use of the alloys of the present invention, as processing is rendered less critical and less complicated, while the product obtained is uniformly and consistently acceptable.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A copper base alloy in the cast condition, said alloy exhibiting a substantially non-dendritic grain structure, said alloy being characterized by improved resistance to cracking during hot rolling, said alloy consisting essentially of from about 4.0 to about 11.0% tin, from about 0.01 to about 0.3% phosphorus, from about 1.9 to about 3.0% of a material selected from the group consisting of iron and a mixture of iron and cobalt, up to about 0.4% chromium, balance essentially copper, wherein the minimum iron plus cobalt content is determined by the equation: [% iron + (0.56) (%cobalt)] $\geqq$ [1.9 − (2) (% chromium)], said alloy being characterized when placed in the wrought condition by the substantial absence of phosphorus-rich and tin-rich low melting phases.

2. The alloy of claim 1 containing from about 0.05 to about 0.4% chromium.

3. The alloy of claim 1, said alloy having been worked into a wrought condition, wherein there is a substantial absence of phosphorus-rich and tin-rich low melting phases.

4. The alloy of claim 1 wherein phosphorus is present in an amount ranging from about 0.01 to about 0.10%, and chromium is present in an amount ranging from about 0.05 to about 0.3%.

5. A copper base alloy in the cast condition, said cast alloy having a substantially non-dendritic grain structure and improved resistance to crack propagation during hot working, said alloy consisting essentially of from about 4.0 to about 6.0% tin, from about 0.01 to about 0.03% phosphorus, from about 1.9 to about 2.5% iron, from about 0.1 to about 0.3% chromium, balance essentially copper, wherein said alloy is characterized when placed in the wrought condition by the substantial absence of phosphorus-rich and tin-rich low melting phases.

6. The alloy of claim 5, said alloy having been worked into a wrought condition, wherein there is a substantial absence of phosphorus-rich and tin-rich low melting phases.

7. The alloy of claim 6 wherein said alloy is in the cold rolled and annealed temper.

8. The alloy of claim 7 wherein said alloy possesses an average grain size of less than 0.01 millimeters after an annealing treatment is conducted at a temperature of approximately 600° C. for a time of approximately 1 hour.

9. The alloy of claim 6 wherein said alloy is in the cold rolled temper.

* * * * *